US007929270B2

(12) United States Patent
Hummel et al.

(10) Patent No.: US 7,929,270 B2
(45) Date of Patent: Apr. 19, 2011

(54) WIRELESS DETONATOR ASSEMBLIES, AND CORRESPONDING NETWORKS

(75) Inventors: Dirk Hummel, Hennef (DE); Michael John McCann, Chadds Ford, PA (US)

(73) Assignee: Orica Explosives Technology Pty Ltd, Victoria (AU)

( * ) Notice: Subject to any disclaimer, the term of this patent is extended or adjusted under 35 U.S.C. 154(b) by 622 days.

(21) Appl. No.: 11/795,793

(22) PCT Filed: Jan. 24, 2006

(86) PCT No.: PCT/AU2006/000085

§ 371 (c)(1),
(2), (4) Date: Jun. 3, 2008

(87) PCT Pub. No.: WO2006/076777

PCT Pub. Date: Jul. 27, 2006

(65) Prior Publication Data

US 2009/0193993 A1 Aug. 6, 2009

Related U.S. Application Data

(60) Provisional application No. 60/646,312, filed on Jan. 24, 2005.

(51) Int. Cl.
*F23Q 7/00* (2006.01)

(52) U.S. Cl. ..... 361/249

(58) Field of Classification Search ..... 361/249
See application file for complete search history.

(56) References Cited

U.S. PATENT DOCUMENTS

| | | | | |
|---|---|---|---|---|
| 4,777,880 | A | 10/1988 | Beattie et al. | |
| 4,860,653 | A | 8/1989 | Abouav et al. | |
| 4,869,171 | A | 9/1989 | Abouav et al. | |
| 6,173,651 | B1 | 1/2001 | Pathe et al. | |
| 7,568,429 | B2 * | 8/2009 | Hummel et al. | 102/206 |

FOREIGN PATENT DOCUMENTS

| | | | |
|---|---|---|---|
| CA | 2423936 | A | 3/2003 |
| WO | WO-2004/020934 | A | 3/2004 |
| WO | WO-2005/052498 | A | 6/2005 |

* cited by examiner

*Primary Examiner* — Stephen W Jackson
(74) *Attorney, Agent, or Firm* — Birch, Stewart, Kolasch & Birch, LLP

(57) ABSTRACT

Wireless detonator assemblies (51-59) in use, form a cross-communicating network of wireless "detonator assemblies, such that communication of each wireless detonator assembly (57-59) with an associated blasting machine (50) can occur either directly, or via relay of signals (61-69) between other wireless detonator assemblies (51-56) in the network. Wireless detonator assemblies (51-59) can disseminate information (such as status information, identity information, firing codes, delay times and environmental conditions) among all of the wireless detonator assemblies in the network, while compensating for signal transmission relay delays at nodes in the network, thereby enabling the wireless detonator assemblies to detonate the explosive charges in accordance with the delay times. Various wireless detonator assemblies and corresponding blasting apparatus are disclosed and claimed. Methods of blasting using the wireless detonator assemblies and blasting apparatus are also disclosed and claimed.

86 Claims, 6 Drawing Sheets

WIRELESS DETONATOR ASSEMBLIES, AND CORRESPONDING NETWORKS

This application is the National Phase of PCT International application No. PCT/AU2006/000085 filed on Jan. 24, 2006 which claims priority under 35 U.S.C. 119(e) on U.S. Provisional Application No(s). 60/646,312 filed on Jan. 24, 2005. The entire contents of the prior application are hereby expressly incorporated by reference into the present application.

FIELD OF THE INVENTION

The present invention relates to the field of wireless detonator assemblies, their organization into a network, and their timed actuation at a blast site.

BACKGROUND TO THE INVENTION

The operation of electronically timed detonators, also known as electronic delay detonators, or EDDs, for blasting, mining, quarrying and similar operations is conventionally performed by use of a network or harness of wires that connect all the detonators together and to the devices that control them. Typically, each detonator is located below ground in the bulk of the explosive material, with a connection made to the aforesaid harness at the top of the hole which contains the explosive.

This surface harness wire network has to be connected together and the detonators connected to it. This process causes significant labour costs and generates many of the faults that occur due to failed or damaged connections. Moreover, the wire itself becomes a nuisance. Firstly it prevents easy movement of men and vehicles over the blasting site and is itself easily damaged. Secondly it has to be gathered for disposal being unfit for reuse or it becomes an undesirable material contaminant of the ore body being extracted.

It is therefore desirable to eliminate the surface wiring for EDDs and control the detonators remotely using some wireless means of communication. EDDs to be effective and safe preferably have two way communication with the controlling device in direct communication with the detonators, also known as the blasting machine. Often, the communication means must therefore provide reliable transfer of messages, from a blasting machine to a large number of EDDs. The physical circumstances, particularly in open cast mining or quarrying, give rise to EDDs being laid out in patterns that can extend several hundreds of metres over somewhat irregular terrain.

Persons of skill in the art recognize the potential of wireless detonator systems for significant improvement in safety at the blast site. By avoiding the use of physical connections (e.g. electrical wires, shock tubes, LEDC, or optical cables) between detonators, and other components at the blast site (e.g. blasting machines) the possibility of improper set-up of the blasting arrangement is reduced. With traditional, "wired" blasting arrangements (wherein the wires can include e.g. electrical wires, shock tubes, LEDC, or optical cables), significant skill and care is required by a blasting operator to establish proper connections between the wires and the components of the blasting arrangement. In addition, significant care is required to ensure that the wires lead from the explosive charge (and associated detonator) to a blasting machine without disruption, snagging, damage or other interference that could prevent proper control and operation of the detonator via the attached blasting machine. Wireless blasting systems offer the hope of circumventing these problems.

Another advantage of wireless blasting systems relates to facilitation of automated establishment of the explosive charges and associated detonators at the blast site. This may include for example automated detonator loading in boreholes, and automated association of a corresponding detonator with each explosive charge. Automated establishment of an array of explosive charges and detonators at a blast site, for example by employing robotic systems, would provide dramatic improvements in blast site safety since blast operators would be able to set up the blasting array from entirely remote locations. However, such systems present formidable technological challenges, many of which remain unresolved. One obstacle to automation is the difficulty of robotic manipulation and handling of detonators at the blast site, particularly where the detonators require tieing-in or other forms of hook up to electrical wires, shock tubes or the like. Wireless detonators and corresponding wireless detonator systems may help to circumvent such difficulties, and are clearly more amenable to application with automated mining operations. In addition, manual set up and tieing in of detonators via physical connections is very labour intensive, requiring significant time of blast operator time. In contrast, automated blasting systems are significantly less labour intensive, since much of the set procedure involves robotic systems rather than blast operator's time.

Progress has been made in the development wireless detonator assemblies, and wireless blasting systems that are suitable for use in mining operations, including detonators and systems that are amenable to automated set-up at the blast site. Nonetheless, existing wireless blasting systems still present significant safety concerns, and improvements are required if wireless systems are to become a viable alternative to traditional "wired" blasting systems.

SUMMARY OF THE INVENTION

It is an object of the present invention, at least in preferred embodiments, to provide an array of detonators at a blast site that can undergo timed actuation.

It is another object of the present invention, at least in preferred embodiments, to provide an apparatus for conducting a blasting event at a blast site, the apparatus including an array of wireless detonator assemblies.

It is another object of the present invention, at least in preferred embodiments, to provide a blasting apparatus, and a corresponding method of blasting, involving wireless communication to control and actuate detonators.

Embodiments and advantages of the present invention will become apparent from a reading and understanding of the entire specification.

In one aspect, the invention provides a blasting apparatus for fragmentation of rock by timed actuation of a plurality of explosive charges each set in a borehole in the rock, the blasting apparatus comprising:

at least one blasting machine for transmitting at least one wireless command signal; and a plurality of wireless detonator assemblies, at least some of which are within range to receive said at least one wireless signal from said at least one blasting machine, each wireless detonator assembly associated with a corresponding explosive charge for causing actuation thereof upon transmission of a FIRE signal by an associated blasting machine, each wireless detonator assembly comprising:

(a) a base charge;

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c);

whereby the wireless detonator assemblies form a cross-communicating network of wireless detonator assemblies, each either in direct communication with said at least one blasting machine, or in indirect communication with said at least one blasting machine via relay of wireless signals to or from said at least one blasting machine via one or more nodes in the network, each node comprising a wireless detonator assembly.

In another aspect, the invention provides for a wireless detonator assembly suitable for use in connection with the blasting apparatus of the invention, the wireless detonator assembly comprising:

(a) a base charge;

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c).

In another aspect the invention provides a top-box, for use in connection with a detonator comprising a base charge and adapted for association with an explosive charge in borehole, the top-box adapted for location above the ground or at least in said borehole adjacent a surface of the ground, the top-box comprising:

(a) a clock suitable for timing initiation of said base charge in accordance with a programmed delay time.

In another aspect the invention provides for a method of blasting at a blast site, the method comprising the steps of:

providing a blasting apparatus according to any one of the invention;

placing a plurality of explosive charges at the blast site;

associating each wireless detonator assembly with each explosive charge such that actuation of each base charge will cause actuation of each associated explosive charge;

transmitting a wireless command signal to FIRE from said at least one blasting machine to each wireless detonator assembly, either directly, or indirectly via relay of each wireless command signal from one wireless detonator assembly to another.

In another aspect the invention provides for a method for timed actuation of a plurality of wireless detonator assemblies each comprising a base charge to be initiated in accordance with said delay times upon receipt of a signal to FIRE from at least one associated blasting machine, the method comprising the steps of:

providing a network of wireless detonator assemblies, each capable of receiving a wireless signal from a blasting machine or another wireless detonator assembly, and performing an action as required by the wireless signal and/or relaying the wireless signal to other wireless detonator assemblies in the network;

establishing a time zero;

programming each wireless detonator assembly in the network with a delay time from time zero for initiation of each base charge associated with each wireless detonator assembly;

calculating for each wireless detonator assembly an amount of time from time zero to initiate actuation of each associated base charge, according to equation X:

amount of time from time zero to initiate the base charge=(time zero+programmed delay time specific for each wireless detonator assembly)−total time to process and relay said FIRE signal at each intermediary node in the network between said at least one blasting machine and each wireless detonator assembly; (X)

whereby each clock in each wireless detonator assembly counts down said amount of time from time zero to initiate the base charge upon receipt of a FIRE signal, thereby to cause timed initiation of each wireless detonator assembly.

In other aspects the invention provides for a use of the blasting apparatus, a wireless detonator assembly, or a top-box of the invention, in a mining operation.

In another aspect the invention provides for a blasting apparatus for fragmentation of rock by timed actuation of a plurality of explosive charges each set in a borehole in the rock, the blasting apparatus comprising:

at least one blasting machine for transmitting at least one wireless command signal;

one or more wireless trunk lines each comprising one or more relay devices for relaying said at least one wireless command signal; and a plurality of wireless detonator assemblies, each in wireless signal communication either directly with said at least one blasting machine, or indirectly with said at least one blasting machine via one or more relay devices in one of said wireless trunk lines, each wireless detonator assembly associated with a corresponding explosive charge for causing actuation thereof upon transmission of a FIRE signal by an associated blasting machine.

In another aspect the invention provides for a method of blasting at a blast site, which comprises:

providing explosive charges at a plurality of locations and providing each charge with an operable detonator assembly;

establishing communication among said detonator assemblies, and communication between at least one of said detonators and a blasting machine;

communicating at least one signal between said blasting machine and said at least one detonator assembly, said at least one signal containing firing information for said detonators; and causing said detonator assemblies to disseminate said firing information among all said detonator assemblies, while compensating for signal transmission delays among said detonators, thereby enabling said detonators to detonate said explosive charges in accordance with said firing information.

DEFINITIONS

Figure 1:
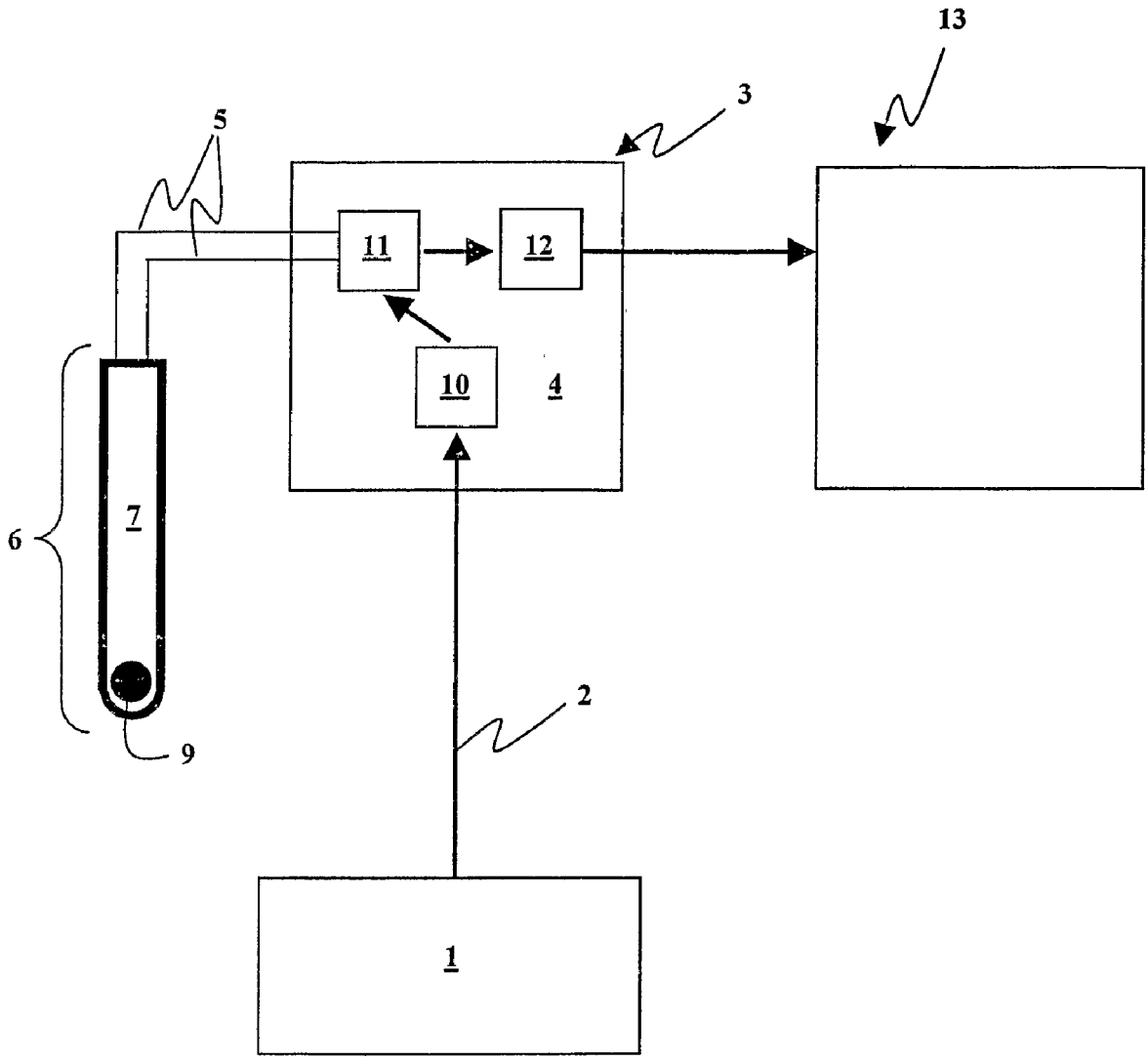
FIG. 1 provides a schematic illustration of a wireless detonator assembly and blasting machine relationship in accordance with a preferred embodiment of the present invention.
Figure 2:
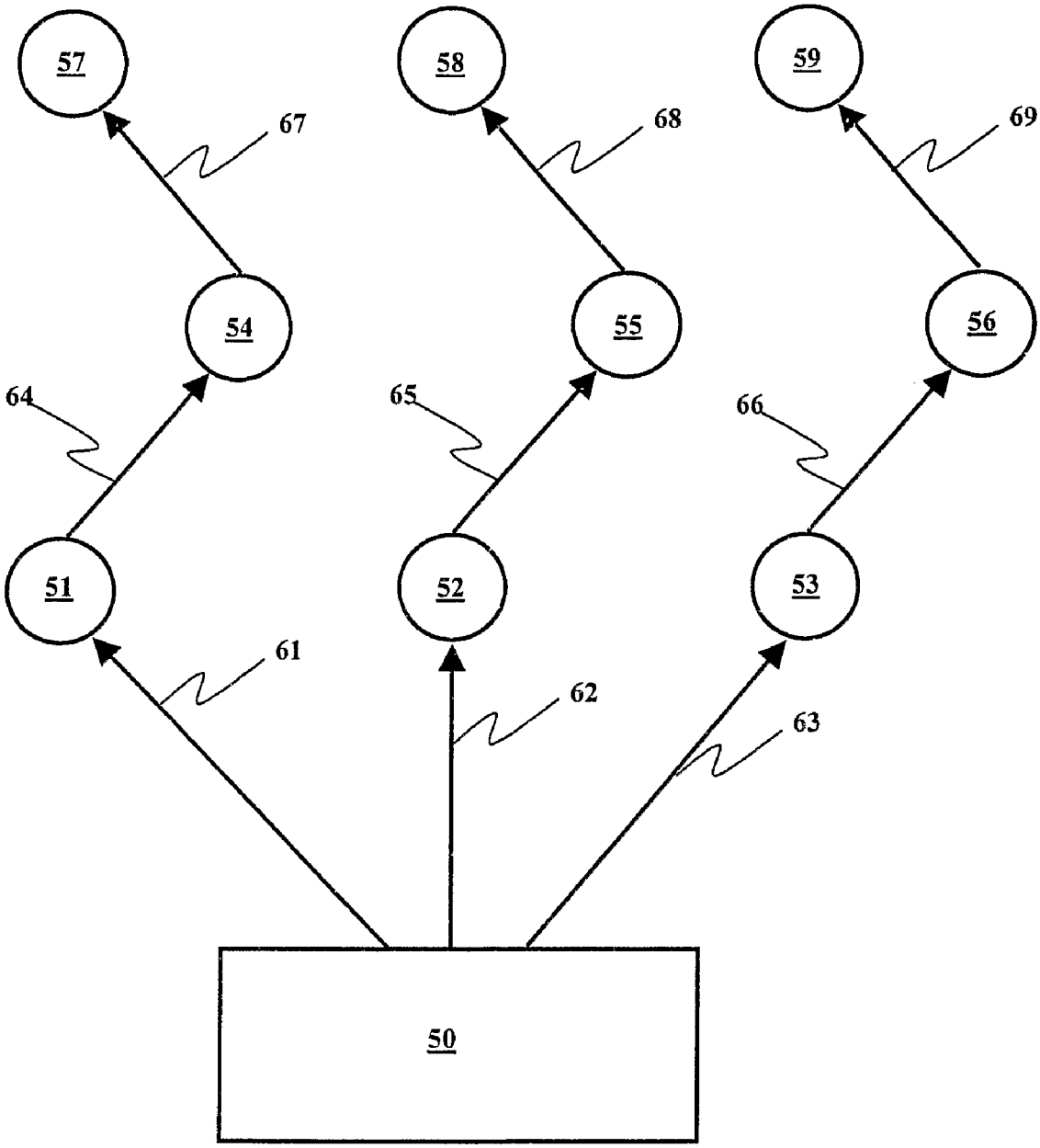
FIG. 2 provides a schematic illustration of a blasting apparatus in accordance with a preferred embodiment of the present invention.

Automated/automatic blasting event: encompasses all methods and blasting systems that are amenable to establishment via remote means for example employing robotic systems at the blast site. In this way, blast operators may set up a blasting system, including an array of detonators and explosive charges, at the blast site from a remote location, and control the robotic systems to set-up the blasting system without need to be in the vicinity of the blast site.

Base charge: refers to any discrete portion of explosive material in the proximity of other components of the detonator and associated with those components in a manner that allows the explosive material to actuate upon receipt of appropriate signals from the other components. The base charge may be retained within a main casing of a detonator, or alternatively may be located without any casing. The base charge may be used to deliver output power to an external explosives charge to initiate the external explosives charge.

Blasting machine: refers to any device that is capable of being in signal communication with electronic detonators, for example to send ARM, DISARM, and FIRE signals to the detonators, and/or to program the detonators with delay times and/or firing codes. The blasting machine may also be capable of receiving information such as delay times, status information, or firing codes from the detonators directly, or this may be achieved via an intermediate device to collect detonator information and transfer the information to the blasting machine, Central command station: refers to any device that transmits signals via radio-transmission or by direct connection, to one or more blasting machines. The transmitted signals may be encoded, or encrypted. Typically, the central command station permits radio communication with multiple blasting machines from a location remote from the blast site.

Charge/charging/powering-up: refers to the act of causing a wireless detonator assembly of the invention to receive energy from a remote source, and convert the energy into electrical energy that is ultimately for use in activating a firing circuit to cause actuation of an associated base charge upon receipt of appropriate command signals. Preferably the energy is received through wireless means. 'Charging' and 'powering-up' have substantially the same meaning in the context of the present invention.

Clock: encompasses any clock suitable for use in connection with a wireless detonator assembly and blasting system of the invention, for example to time delay times for detonator actuation during a blasting event. In particularly preferred embodiments, the term clock relates to a crystal clock, for example comprising an oscillating quartz crystal of the type that is well known, for example in conventional quartz watches and timing devices. Crystal clocks may provide particularly accurate timing in accordance with preferred aspects of the invention, and their fragile nature may in part be overcome by the teachings of the present application.

Electromagnetic energy: encompasses energy of all wavelengths found in the electromagnetic spectra. This includes wavelengths of the electromagnetic spectrum division of γ-rays, X-rays, ultraviolet, visible, infrared, microwave, and radio waves including UHF, VHF, Short wave, Medium Wave, Long Wave, VLF and ULF. Preferred embodiments use wavelengths found in radio, visible or microwave division of the electromagnetic spectrum.

Electronic delay detonator (EDD): refers to any form of detonator that is able to process electronic signals originating for example from an blasting machine.

Energy source: encompasses any source of energy that is capable of wirelessly transmitting energy to a detonator for the purpose of 'powering-up' or 'charging' the detonator for firing. In preferred embodiments the energy source may comprise a source of electromagnetic energy such as a laser.

Forms of energy/wireless signals: refers to any form of energy appropriate for wireless signals/wireless communication and/or wireless charging of the detonators. For example, such forms of energy may include, but are not limited to, electromagnetic energy including light, infrared, radio waves (including ULF), and microwaves, or alternatively make take some other form such as electromagnetic induction or acoustic energy. In addition, "forms" of energy may pertain to the same type of energy (e.g. light, infrared, radio waves, microwaves etc.) but involve different wavelengths or frequencies of the energy. Preferably, where radio communications are utilized, the radio signals have a frequency of 100-2000 Hz, more preferably 200-1200 Hz.

Logging device: includes any device suitable for recording information with regard to the position of a detonator. Preferably, the logging device may also record additional information such as, for example, identification codes for each detonator, information regarding the environment of the detonator, the nature of the explosive charge in connection with the detonator etc. In selected embodiments, a logging device may form an integral part of a blasting machine, or alternatively may pertain to a distinct device such as for example, a portable programmable unit comprising memory means for storing data relating to each detonator, and preferably means to transfer this data to a central command station or one or more blasting machines.

Firing power supply: includes any electrical source of power that does not provide power on a continuous basis, but rather provides power when induced to do so via external stimulus. Such power sources include, but are not limited to, a diode, a capacitor, a rechargeable battery, or an activatable battery. Preferably, a firing power source is a power source that may be charged and discharged with ease according to received energy and other signals. Most preferably the passive power source is a capacitor.

Top-box: refers to any device forming part of a wireless detonator assembly that is adapted for location at or near the surface of the ground when the wireless detonator assembly is in use at a blast site in association with a bore-hole and explosive charge located therein. Top-boxes are typically located above-ground or at least in a position in, at or near the borehole that is more suited to receipt and transmission of wireless signals, and/or for relaying these signals to the detonator down the borehole. In preferred embodiments, each top-box comprises (one or more selected components of the wireless detonator assembly of the present invention.

Network: refers to wireless detonator assemblies in a blasting apparatus of the present invention in which at least one wireless detonator assembly is able to communicate via wireless communication means with a least one other wireless detonator assembly, thereby to create a network of intercommunicating wireless detonator assemblies at the blast site. The network of wireless detonator assemblies may include those that communicate directly with the one or more blasting machines at the blast site, which form an integral part of the blasting apparatus.

Micro-nuclear power source: refers to any power source suitable for powering the operating circuitry, communications circuitry, or firing circuitry of a detonator or wireless detonator assembly according to the present invention. The nature of the nuclear material in the device is variable and may include, for example, a tritium based battery.

Node: refers to a single communication point in a network as described herein. In particular, node refers to a top-box/detonator combination, a wireless detonator assembly, or relay device located in any position in the blasting network. In selected embodiments, a node may also refer to a blasting machine in the network, since each blasting machine may also be involved in cross-communication with one or more top-boxes in the network.

Operating power supply: refers to any power source that can provide a continuous or constant supply of electrical energy. This definition encompasses devices that direct current such as a battery or a device that provides a direct or alternating current. Typically, an active power source provides power to a wireless signal receiving and/or processing means in a wireless detonator assembly, to permit reliable reception and interpretation of command signals derived from a blasting machine.

Preferably: identifies preferred features of the invention. Unless otherwise specified, the term preferably refers to preferred features of the broadest embodiments of the invention, as defined for example by the independent claims, and other inventions disclosed herein.

Wireless detonator assembly: refers in general to an assembly encompassing a detonator, most preferably an electronic detonator (typically comprising at least a detonator shell and a base charge) as well as wireless signal receiving and processing means to cause actuation of the base charge upon receipt by said wireless detonator assembly of a wireless signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to wirelessly transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to an electronic delay detonator or any other form of detonator. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator for actuation thereof, in effect forming wireless branch lines in the wireless network. A wireless detonator assembly may further include a top-box as defined herein, for retaining specific components of the assembly away from an underground portion of the assembly during operation, and for location in a position better suited for receipt of wireless signals derived for example from a blasting machine or relayed by another wireless detonator assembly.

Wireless: refers to there being no physical connections (such as electrical wires, shock tubes, LEDC, or optical cables) connecting the detonator of the invention or components thereof to an blasting machine or power source.

Wireless electronic delay detonator (WEDD): refers to any electronic delay detonator that is able to receive and/or transmit wireless signals to/from other components of a blasting apparatus. Typically, a WEDD takes the form of, or forms an integral part of, a wireless detonator assembly as described herein.

DETAILED DESCRIPTION OF THE PREFERRED EMBODIMENTS

The inventors have succeeded in the development of a blasting apparatus or system that involves wireless communication at the blast site between blasting machines and associated wireless detonator assemblies. Importantly, the inventors recognize the difficulties presented in wireless communications for blasting apparatuses, and in particular the difficulty in ensuring reliable wireless communication under circumstances where selected detonators may be "blind" or poorly positioned to receive wireless signals.

The inventors have conceived and developed a wireless blasting apparatus in which detonators and associated components, at least in preferred embodiments, communicate with associated blasting machines, and with one another, via wireless communication signals, thereby to generate a wireless communication network at the blast site. In this way, the integrity of wireless command signals derived from a blasting machine and transmitted to detonators, can be enforced by relay of the signals between wireless detonator assemblies. Likewise, the network of wireless detonator assemblies permits relay of signals from the detonators, for example detonator identification information, delay times, firing codes, and detonator clock synchronizations, to the blasting machines, even if individual detonators and top-boxes are out of range of the blasting machines. Communication between nodes of the network thus overcomes in part the difficulties in wireless communications at the blast site.

In preferred aspects, the invention pertains to an "asymmetric" blasting system in which the blasting machines can communicate directly with all of the wireless detonator assemblies at the blast site. In contrast, at least some of a plurality of wireless detonator assemblies are out of range to transmit wireless signals directly to the blasting machines. To overcome this problem, the wireless detonator assemblies form a network, with some of the wireless detonator assemblies in direct wireless communication with the blasting machines, and others in communication with the blasting machines by relay of wireless signals through those wireless detonator assemblies in direct signal communication with the blasting machines.

The wireless detonator assemblies preferably employ low-voltage or low-powered power supplies for general communication including the receipt, processing and transmission of wireless signals received from blasting machines or other wireless detonator assemblies. This minimizes the risk of inadvertent detonator actuation arising from stray communications signals, or the inadvertent application of communications power to the firing circuitry. Most preferably, a signal of sufficient power to initiate the detonator is generated only upon receipt of a command signal to FIRE from an associated blasting machine.

Further particularly preferred aspects of the present invention relate to the control of delay times in the blasting apparatus of the present invention. In selected embodiments, the invention provides for a blasting apparatus comprising a network of wireless detonator assemblies, wherein wireless command signals derived from a blasting machine are transmitted to all wireless detonator assemblies of the blasting apparatus either directly or via relay of the signals through one or more wireless detonator assemblies. This can create an inherent problem with regard to detonator delay times, since processing times at each node of the network (e.g. in a top-box for each relay step) can disrupt to synchronicity of the signals. The invention encompasses blasting systems, and corresponding methods of blasting, where such problems are overcome by calculating for each wireless detonator assembly a time for which the transfer of delay time data has been 'held-up' in the network by processing times at each node, in accordance with each step in the relay of the signal to the receiving wireless detonator assemblies. The invention therefore provides a means for compensating for processing times in each step of the relay process, thereby ensuring proper co-ordination of the blasting sequence, and proper control of a firing sequence by delay times in accordance with the requirements of the blast event.

In general the expression "wireless detonator assembly" encompasses a detonator (typically comprising at least a detonator shell and a base charge) as well as means to cause actuation of the base charge upon receipt by the wireless detonator assembly of a signal to FIRE from at least one associated blasting machine. For example, such means to cause actuation may include signal receiving means, signal processing means, and a firing circuit to be activated in the event of a receipt of a FIRE signal. Preferred components of the wireless detonator assembly may further include means to transmit information regarding the assembly to other assemblies or to a blasting machine, or means to relay wireless signals to other components of the blasting apparatus. Other preferred components of a wireless detonator assembly will become apparent from the specification as a whole. The expression "wireless detonator assembly" may in very specific embodiments pertain simply to a wireless signal relay device, without any association to a detonator unit. In such embodiments, such relay devices may form wireless trunk lines for simply relaying wireless signals to and from blasting machines, whereas other wireless detonator assemblies in communication with the relay devices may comprise all the usual features of a wireless detonator assembly, including a detonator unit for actuation thereof, in effect forming wireless branch lines in the wireless network.

Further embodiments and advantages of the present invention will become apparent from a reading and understanding of the entire specification.

A preferred embodiment of the present invention is shown in FIG. 1*a*. There is shown a blasting machine 1 in wireless signal communication 2 with a wireless detonator assembly shown generally at 3. The wireless detonator assembly 3 includes a top box 4 connected via wires 5 to a below-ground portion 6. The below ground portion 6 includes a detonator 7 comprising a shell 8 and a base charge 9. The top box includes wireless signal receiving means 10 for receiving a wireless signal (in FIG. 1 this comprises wireless signal 2 from blasting machine 1). The top box further includes wireless signal processing means 11 for determining an action required by the wireless detonator assembly 3 in response to wireless signal 2. For example, the signal processing means 11 may determine that the wireless detonator assembly is to transmit or relay the wireless signal in question. In this scenario, wireless signal transmitting means 12 may transmit the wireless signal to another wireless detonator assembly shown generally at 13. On the other hand, if wireless signal processing means 11 determines that wireless signal 2 is directed specifically for wireless detonator assembly 3, then the wireless signal processing means 11 may cause arming and/or firing of the base charge 9 via wires 5 and detonator 7.

The wireless signal 2 may take any form that is suitable for transmitting signals from a blasting machine to the top box. Such wireless communications means may take any form appropriate for wireless communication with wireless detonator assembly 3. Furthermore, wireless detonator assembly may be capable of receiving other wireless signals for the purposes of powering up or charging the detonator assembly for firing of the firing circuit. For example, such wireless signals may include forms of energy that may include, but are not limited to, electromagnetic energy including light, infrared, radio waves (including ULF), and microwaves, or alternatively may take some other form such as electromagnetic induction or acoustic energy. In any event, wireless signals for communication may take the form, for example, of digitally encoded signals which are part of a restricted and carefully designed message set.

The top-box 4 is shown to communicate with the below-ground portion 6 via wires 5. Other communication means between the top-box and the below-ground portion are also feasible and within the realms of the invention. Such other means may include wireless communication means.

In operation, the blasting machine may communicate with and control many wireless detonator assemblies, each similarly configured. Such a blasting apparatus is shown in FIG. 1*b*. Only a single blasting machine 50 is illustrated, which is in communication with a plurality of wireless detonator assemblies 51, 52, 53, 54, 55, 56, 57, 58, and 59. Blasting machine 50 is able communicate directly via some form of wireless signal communication 61, 62, 63 with wireless detonator assemblies 51, 52, and 53. However, the remaining wireless detonator assemblies 54 to 59 in FIG. 1*b* are 'blind' to the blasting machine 50. For example, the remaining blasting machines 54 to 59 may be out of range of blasting machine 50, or alternatively may be unable to receive signals from blasting machine 50 due to physical obstruction or interference blocking wireless signal communication. Nonetheless, wireless detonator assemblies 54-59 are able to receive, and optionally send, wireless signals to blasting machine 50 through relay of the wireless signals via other wireless detonator assemblies. For example, wireless signal 61 may be received via wireless detonator assembly 51. The signal processor of wireless detonator assembly 51 (not shown in FIG. 1*b*) may determine that the wireless signal is not directed to that wireless detonator assembly, and relay the wireless signal to the next wireless detonator assembly 54 via wireless signal 64. In turn, if the wireless detonator assembly 54 determines via its own signal processor (not shown) that the wireless signal 64 is not directed to that wireless detonator assembly, then it may also relay the wireless signal via 67 to wireless detonator assembly 57. Upon receipt of wireless signal 67, wireless detonator assembly 57 may determine via its own signal processor that the wireless signal 67 is a FIRE signal directed to itself, thereby causing a detonator associated with the wireless detonator assembly to be actuated.

It follows that each of wireless detonator assemblies 57, 58, and 59 shown in FIG. 1*b* can receive a wireless signal from the blasting machine 50 even though they are 'blind' to the blasting machine. They each rely upon relay of the wireless signal via two other wireless detonator assemblies. Although not shown in FIG. 1*b*, it will be appreciated that the wireless signals may be sent from the blasting machine 50 either directly or via relay to the wireless detonator assemblies, or alternatively, wireless signals may be transmitted from the wireless detonator assemblies to the blasting machine 50. Preferably, the wireless signals are accompanied by an identification tag (e.g. in the form of a data packet) indicative of the target component of the blasting apparatus to which the wireless signal is directed. In this way, each component of the blasting apparatus upon receipt of a wireless signal can determine whether to act upon the signal (if the signal is directed to that component) and/or whether to relay the signal elsewhere in the network of wireless detonator assemblies, or back to the blasting machine.

In selected embodiments, the blasting machine may be able to function to program the wireless detonator assemblies in the network. For example, the wireless blasting assemblies may be programmed with identification codes unique to each wireless detonator assembly, as well as delay times, firing codes, and other programming information familiar to those of skill in the art. In this way, the blasting machine may function as a logger, but in contrast to a conventional logger that has only very short range communication capabilities, the blasting machine may remain in one place at the blast site. Moreover, the blasting machine may contact each wireless detonator assembly in the network to request status information for the wireless detonator assembly. In effect, the blasting machine may execute a "role call" for the wireless detonator assemblies, and/or request information such as for example, delay times, identification information, environment conditions etc.

In other selected embodiments of the blasting apparatus of the invention, the wireless signals generated and transmitted by the wireless detonator assemblies may include information regarding the hierarchy of wireless detonator assemblies in the network. For example, with reference again to FIG. 1*b*, the wireless signal transmitted to wireless detonator assemblies may include supplementary information regarding their origin and relay path, for storage by each wireless detonator assembly. In this way, each wireless detonator assembly may "learn" its position in the network, and be able to transmit wireless signals back to the blasting machine 50 (either directly or by relay) to inform the blasting machine of its position in the network relative to other wireless detonator assemblies. Preferably, this can enable the blasting machine to generate and "learn" a "picture" of the network of wireless detonator assemblies under its control. For example, wireless detonator assembly 59 may inform blasting machine 50 that it can receive signals from the blasting machine via relay by wireless detonator assemblies 53 and 56. In turn this can inform the blasting machine 50 that wireless detonator assemblies 56 and 59 are within a sector of wireless detonator assemblies with range of wireless detonator assembly 53.

The network of wireless detonator assemblies shown in FIG. 1*b* is relatively simple in nature. Other more complex networks, wherein for example significant cross-talk occurs between wireless detonator assemblies, is within the realms of the present invention. To provide one example, wireless detonator assembly 58 could receive wireless signals relayed by any one or more of wireless detonator assemblies 51 to 56. In this way, multiple relay paths would be available to relay the wireless signal to wireless detonator assembly 58, thereby minimizing the possibility of wireless signal disruption and loss of blasting machine communication with wireless detonator assembly 58.

In other selected embodiments, the blasting apparatuses of the invention may work as a master-slave system in which dialogue is only ever initiated by the master, in this case the blasting machine.

Each blasting machine and each wireless detonator assembly may preferably include some form of antennae to enable communications with other components of the apparatus. The antennae used in this system are preferably designed to function efficiently in the chosen frequency range. They may be directional, may be built in to the surfaces of the devices for protection in a rough working environment, or may be in any convenient form as will be apparent to those skilled in the art of wireless communications.

Preferably, for each wireless detonator assembly the EDD (which for example comprises the below-ground portion of the assembly) is not connected to the top box until the final stages of the operation, when the logging process enables the users to identify each EDD with a particular hole or explosive charge. Preferably, for powering communications each top-box contains a small battery or other low voltage electrical energy source, such as a fuel cell, an air cell, such as a hearing aid battery, a micro-nuclear power source, a capacitor, or some other means of generating electric current, such that the potential thereof is insufficient to initiate the explosive charge. In this way, no wireless detonator assemblies are shipped which contain both explosive and battery, nor do the combined devices have between them the capability to exercise the firing sequence.

Figure 3:
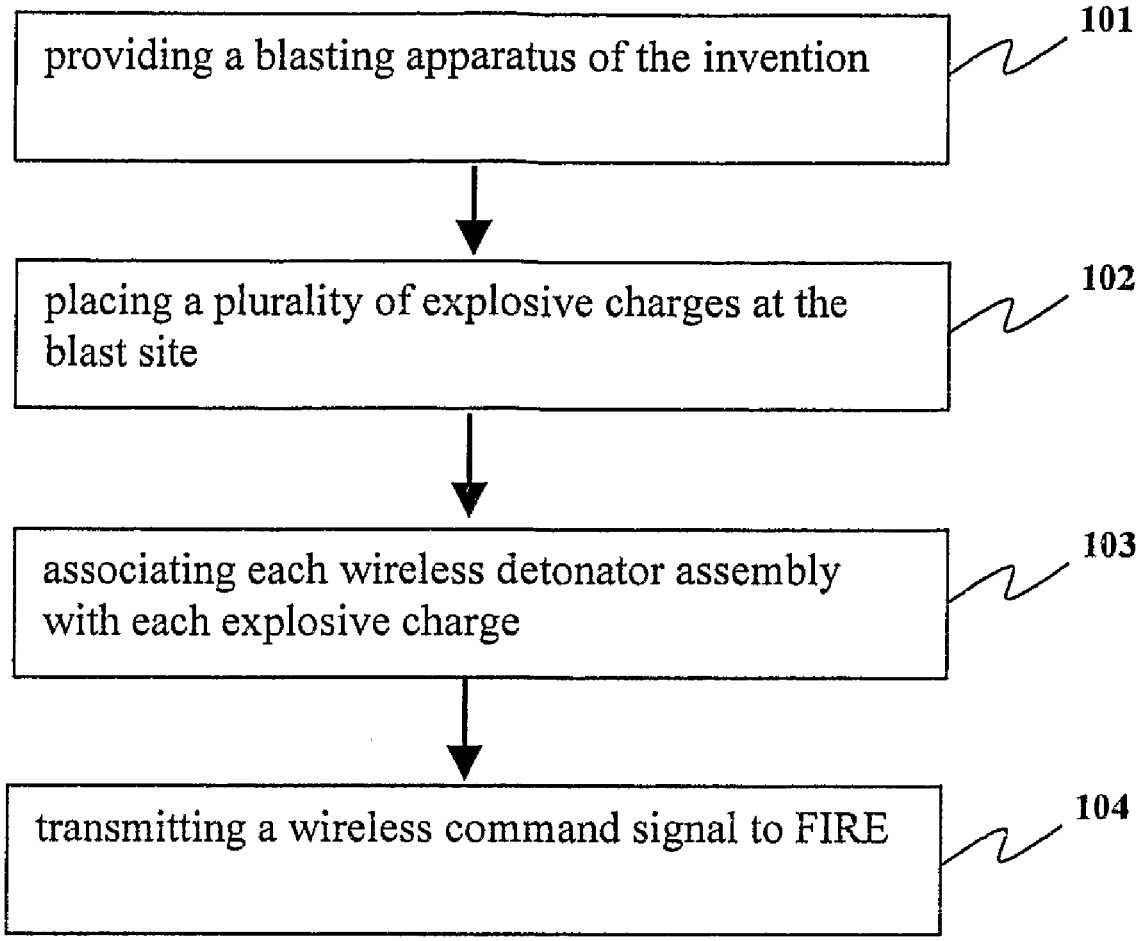
FIG. 3 provides a method of blasting in accordance with a preferred embodiment of the invention.

In other embodiments, the invention encompasses various methods for blasting. For example, the invention includes a method of blasting at a blast site as shown in FIG. 3, the method comprising the steps of:

in step 101 providing a blasting apparatus according to the invention;

in step 102 placing a plurality of explosive charges at the blast site;

in step 103 associating each wireless detonator assembly with each explosive charge such that actuation of each base charge, will cause actuation of each associated explosive charge;

in step 104 transmitting a wireless command signal to FIRE from said at least one blasting machine to each wireless detonator assembly, either directly, or indirectly via relay of each wireless command signal from one wireless detonator assembly to another.

Figure 4:
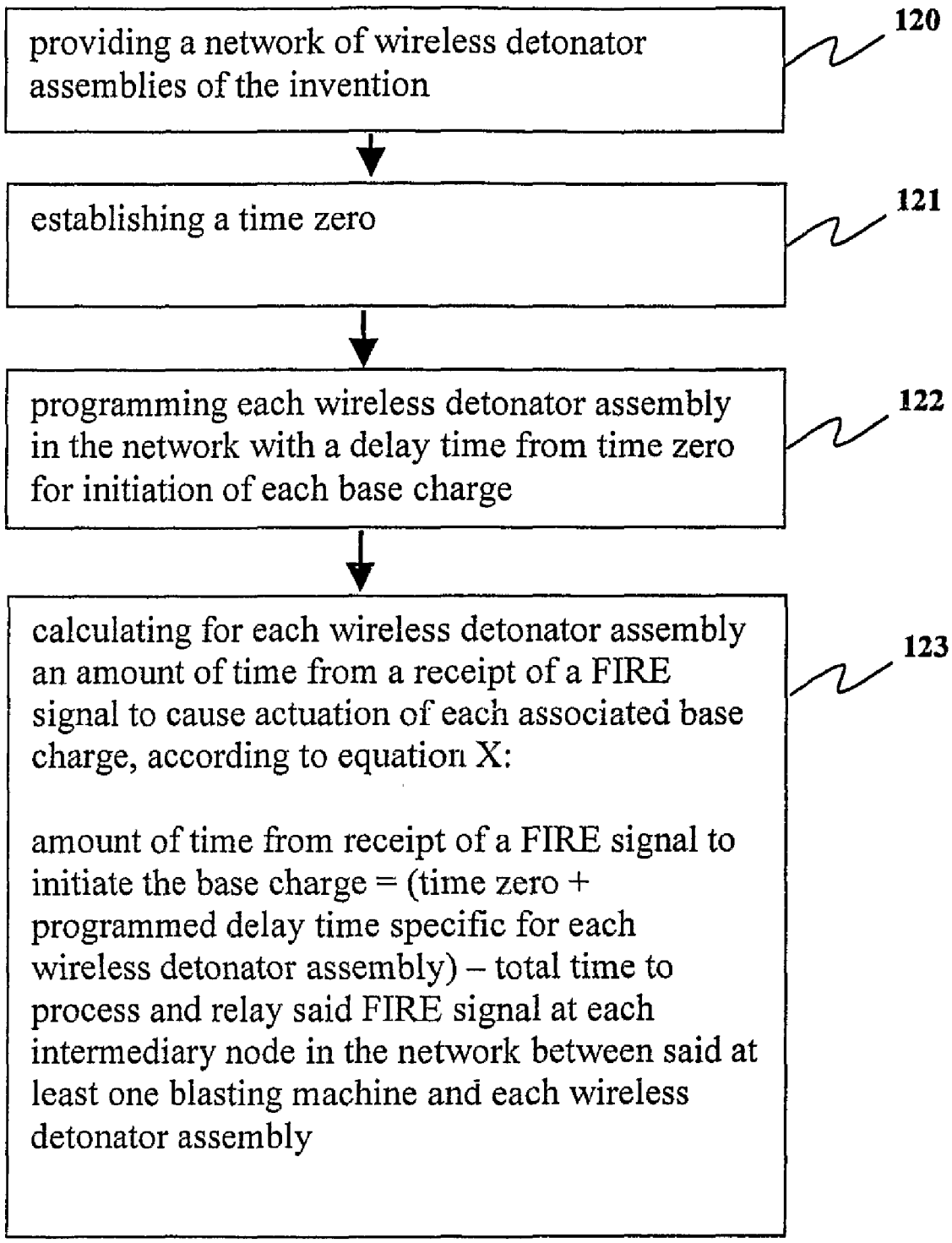
FIG. 4 provides a method of blasting in accordance with a preferred embodiment of the invention.

In another embodiment the invention provides for a method as shown in FIG. 4, for timed actuation of a plurality of wireless detonator assemblies each comprising a base charge to be initiated in accordance with said delay times upon receipt of a signal to FIRE from at least one associated blasting machine, the method comprising the steps of:

in step 120 providing a network of wireless detonator assemblies, each capable of receiving a wireless signal from a blasting machine or another wireless detonator assembly, and performing an action as required by the wireless signal and/or relaying the wireless signal to other wireless detonator assemblies in the network;

in step 121 establishing a time zero;

in step 122 programming each wireless detonator assembly in the network with a delay time from time zero for initiation of each base charge associated with each wireless detonator assembly;

in step 123 calculating for each wireless detonator assembly an amount of time from a receipt of a FIRE signal to cause actuation of each associated base charge, according to equation X:

amount of time from receipt of a FIRE signal to initiate the base charge=(time zero+programmed delay time specific for each wireless detonator assembly)−total time to process and relay said FIRE signal at each intermediary node in the network between said at least one blasting machine and each wireless detonator assembly; (X)

whereby each clock in each wireless detonator assembly counts down said amount of time from receipt of said FIRED signal to initiate the base charge, thereby to cause timed initiation of each wireless detonator assembly. In this way, the invention encompasses methods for blasting involving the blasting apparatuses of the invention, wherein compensation in delay times is made for signal transmission delays at the nodes in the network, thereby allowing for detonators to be actuated at desired times, and in a desired sequence, relative to a start time for the blasting event.

Further various aspect of the invention will become apparent from review of the following examples, which are in no way intended to be limiting and are provided merely to illustrate and clarify particularly preferred embodiment of the invention.

EXAMPLES

Example 1

Discussion of Preferred Logging Device/Top-Box Configurations

In selected embodiments, the blasting apparatus of the present invention may include a logging device for individually programming each wireless detonator assembly. For example, a logging device may instruct the top-box of each wireless detonator assembly, to ascertain the EDD's identity or serial number and in doing so, verify that the communications between top-box and EDD are functioning. The logger may then record information such as the top-box identity number and some location information optionally required for the blasting application.

For logging, the logging device preferably communicates with the top-box in a manner such that there is virtually no possibility that another top-box and associated detonator in the system "overhears" the communication and improperly processes or transmits data to or from the logging device. For example, a logging device may only communicate with a top-box if within very close (e.g. a few metres) of a top-box. A logging device may preferably use a very low power radio means or induction field means such that it appears to the top-box to be generating low magnitude signals, or by other means such as using the technology of RFID (radio frequency identification tags). It is most preferred for this invention that the logging device communicates with one and only one top-box at a time. Otherwise any top-box nearby would be interrogated inadvertently.

The top-boxes may have limited power capabilities, so that radiated power levels from them may preferably be small. They may also be constrained by regulation, depending on the frequencies used, to low power levels. It is convenient, however, for them to use readily available communications standards both in protocols and in signaling, though bandwidth requirements are low compared to most computer based data transfer schema.

The present invention encompasses blasting apparatuses wherein the top-boxes in combination function in a self organizing, "self-organizing" communications network and become a means of providing communications over the whole field. For example, but not restricted to them, any of the IEEE standards in the 802.11 series, the Zigbee standards (IEEE 802.15.4), the IEEE 1451 standard for linking sensors to transceivers, Bluetooth, the TinyOS operating system can provide bases for design. For practical implementation:

nanoNET from Nanotron Technologies GmbH,
Microstrain's "Agile Link",
Aerocomm's Flexible MeshRF,
Crossbow Technology's Smart Dust Motes,
Dust Network's SmartMesh,
Ember's EM2420 transceivers,
Firetide Instant mesh networks,
Kyon's Autonomic Networks,
Mesh Networks system
Millennial Net products
NovaRoam mobile networks
OrderOne scalable networks or other physical implementations of such networks can, for example, be used.

In preferred embodiments, the messages from a blasting machine to the top-boxes are designed in this system so that only an acknowledgment is required, whereas in the i-kon system, for example, the EDDs returned response messages that contained working data. With the use of top-boxes that will contain a small computer chip, much of the detail work can be assigned to it. Thus each instruction (wireless signal) to a top-box may be verified therein to ensure message integrity, the necessary actions may be taken and the top-box may either immediately or on later request, report that all is well. The simplest example is a roll call, carried out as a first part of a blasting sequence. The request for a roll call of all top-boxes may be transmitted by an associated blasting machine. All that is needed is a response from a single top-box. Similarly, a request to perform clock calibration needs only a confirmation, on later request, that all went well.

At specific times, a particularly preferred feature of the blasting apparatus of the present invention allows each blasting machine to send selected messages to all the EDDs simultaneously, for example, to send a firing signal to initiate the count-down to initiation. Return messages, confirming actions and receipt of instructions by the top-boxes need not be transmitted back to a blasting machine simultaneously. For this reason, the return messages may return to a blasting machine via the self-organizing network. Therefore, an asymmetric version of the self organizing network can provide direct transmission from a blasting machine, which can have more power available, with return messages passed via the self-organizing network forwarding frames of data to find their way back to the blaster or its surrogate.

Example 2

Compensation for Signal Transmission Delays at Intermediary Nodes of a Network of Wireless Detonator Assemblies In an "self organizing" network of the present invention, the time for a message to get from master (e.g. a blasting machine) to slave (e.g. one or more wireless detonator assemblies) will vary between nodes of the network (i.e. wireless detonator assemblies acting to relay wireless signals to other nodes in the network). Preferred features of the self-organizing network of the present invention allow for compensation of these variable times. To allow for the time variation for critical messages, the inventors propose the following scheme. Any message that requires synchronism is sent out with a sufficiently large advance time offset, X, so that it says "In time X from now, start the action!". Any device relaying that message may then deduct its own message processing and sending time from X so that eventually when all nodes on the network have received it they all act in synchrony.

Preferably, each detonator assembly should get a message that causes it to start its countdown at the same time as every other detonator in the blasting apparatus. Ideally this should be accurate to a few (e.g. 10 or fewer) microseconds. For many applications, less accuracy, e.g. 200 microseconds may suffice. This is less of problem in a hardwired system or a broadcast system when the messages arrive simultaneously at every device (subject only to signal propagation velocity on the wires or through space). However, in a wireless blasting system comprising a network of wireless detonator assemblies such as those described in the present application, messages reach their destinations by multiple "hops" or relay events in the network, and with variable time delays caused at each signal processing and relay step at each node in the network. In preferred embodiment of the invention, this variability is at least in part overcome as it can exceed the resolution required.

Example 3

Network Communications and Relay Delay Compensation

A number of radio frequency (RF) receiver/transmitter (TX/RX) devices, with attached microprocessors (computers) can organize themselves into communication networks which provide reliability by using multiple paths and achieve network repair, when one of them is damaged, removed or added, by making adjustments to the message passing rules.

The operation of such networks generally employs collision avoidance means in which the RF TX/RX device first listens on the assigned frequency to see if any other device is transmitting and if the channel is clear, starts its own transmission. If not clear then it may wait for a (random) time before trying again. This naturally introduces unpredictable delays in the system, especially if any device on the network may decide at any time to send its own message to another (in peer to peer communications), thus temporarily blocking others. This problem is likely to be less severe in a master-slave application as only the master controller is allowed to initiate messages, the rest of the devices are restricted to replying only when specifically addressed with a request requiring a response.

In accordance with the present invention, a networking system may be designed to provide a means whereby the individual clocks in each device share their current time counts and so by a logical process, allow for each device clock to be coordinated with the others and a master clock in the network.

With this ability, adjustments can be made for them to be able to convert the request for an event to take place at a certain time on the master controller's clock into the corresponding time on their own individual clocks. This is similar to the idea of synchronizing watches for human activities, but in the blasting apparatuses of the present invention, messages take variable times to be passed and so, in preferred embodiments, more complex means of establishing clock synchronization are also encompassed by the present invention.

If the number of relay events required for taken by a wireless signal to reach its destination in the network can be reduced, then the variability in the signal (e.g. with regard to synchronization of delay times) can likewise be reduced. Ultimately the reduction to a single hop puts it in the same category as a broadcast system.

With this in mind, the invention encompasses the use of a limited number of wireless detonator assemblies solely to provide a communications backbone to the network rather like a trunk line in a convention wired blasting arrangement. Alternatively, the backbone may be comprised merely of wireless signal relay devices, each performing the sole function of signal relay, and not being associated with a detonator. Wireless detonator assemblies can then be "linked" to various signal relay components of the backbone, thereby effectively forming wireless branch lines to the backbone.

Moreover, with the benefits of multiple path reliability then arrange for each of the active devices (the wireless detonator assemblies) to be directly reached from one at least of these communication nodes in the backbone of the network. The effect is to attach a star (radial) network to each of the backbone nodes. If the number of relay events is small (down the communications backbone), the pattern of relay events well established and if variability is in relay time is small enough, it may be possible to allow for the propagation time of the messages by adjusting simply for the time per "hop" or relay event, knowing which backbone node is the one dealing with each device. This will require means of estimating (measuring) relay propagation times. The variability can come from the use of collision avoidance in the radio transmissions (part of the IEEE specification), but with a network which only permits master-slave communications, some or all of this may be removed.

The present invention includes the adjustment of instructions embedded in wireless signals, as they propagate through the network to allow for the time taken in each hop or relay event.

Preferably, the detonator assemblies of the present invention include crystal clocks so that drift of timing is substantially avoided.

In general, with radio communication over short distances, the time of sending and the time of receipt of messages are so close that the (relativistic) time skewing is less of a concern. The concern more specifically relates to skewing introduced by processing of time signals during relaying through nodes in the network.

For example, the master (e.g. one or more blasting machine) sends out a message saying, for example, "Start the firing sequence in 20.000 milliseconds". Whenever any device (e.g. a wireless detonator assembly) receives such a message it automatically records the time of arrival of the message in terms of its own (local) clock, which is preferably a crystal clock. In the blasting apparatus of the present invention, the device may be required to send the message on again. In doing so it adjusts the message so that the time it took, measured by its own clock, to process the message and to find a clear channel for communications, is deducted from the remaining time before action is required. So, for example, if its own activities took 127 microseconds, then the transmitted message would become "Start the firing sequence in 19.873 milliseconds".

An equivalent method, which is discussed below in more detail as a means of implementation, is for the devices to add the time taken in processing to a count of message age, which is included in the message, so that in activating firing, the age of the message can be deducted from the specified delay. Indeed, the specified delay may then not need to be transmitted with the message, having been sent in a previous message without time critical reception being needed, or it could be designed into the blasting apparatus of the present invention as a standard.

Example 4

Means of Implementation for Self-Adjusting Delay Times for Wireless Command Signals In preferred embodiments, wireless signals are transmitted using some standard formats which include recognizable wireless signal identification, addressing information, wireless signal length counters in the early part of the wireless signal, actual wireless signal content and checking data (e.g. cyclic redundancy check or "CRC") at the end to identify corrupted messages for a repeat transmission to be called for. The invention includes means for "correcting" the delay time portion of wireless signals to synchronize countdown of wireless detonator assemblies for base charge initiation, in a blasting apparatus of the present invention.

In one embodiment, the initial dialog, conducted over the network, the blasting machine sends out a wireless signal for each wireless detonator assembly to define the nominal delay time to be used between receipt of a "FIRE" message and its activation. Alternatively, delay time values may be pre-programmed into the wireless detonator assemblies, for example using a portable device at the blast site for physical association or close range communication with each wireless detonator assembly. The delay time may be a value chosen by the operator, a value calculated to encompass the measured delay times exhibited by the actual operating network or a standard or default value designed into the system. It need not be sent (though it could be sent) with the "FIRE" message itself. The blasting machine then, when everything is ready to initiate firing, sends out a message which carries the information that it is addressed to every wireless detonator assembly, that it is a "FIRE" message and that its age (for example in microseconds) is zero.

Any wireless detonator assembly that receives the wireless signal records its time of arrival as measured by its own clock. This becomes the reference time for calculating processing and transmission delays. More efficiently this action may, for example, be implemented by resetting a clock pulse counter to the value in the age part of the incoming wireless signal. Preferably, it can be done at the end of the last bit of any wireless signal, before any logical processing of the wireless signal is done. To this end, it is preferably done as an automatic component of message reception in chip hardware. Then, while any logical processing such as verification of CRC, wireless signal interpretation and decision about retransmission is taken, the aforementioned clock pulse counter keeps a running total of elapsed time.

When the message is to be retransmitted, the clock count is adjusted as indicated below and put into the message in place of the zero from the master, or whatever came in the wireless signal as received from another device in the network (e.g. a wireless detonator assembly). Thus each new recipient of the message knows exactly how old it is and can adjust its own delay before starting the firing count to allow for the age of the message.

The adjustments to the age count preferably allow for several items including:

1. Age may be defined by the end of the last bit of the message so the clock count time may have to have the length of time for sending the message added in. The message length is known so this is calculable.

2. After the whole message is assembled, it requires a new CRC value to be calculated. This can also take time, but again the required calculation time may be known and can be added in. It is assumed that during this calculation operation, the microprocessor activities are defined as not interruptible. This fixed calculation time will also allow for the addition operations themselves. In the event that some branching instructions are included in the program, care is preferably taken to ensure that all alternative computation sequences are the same length by inserting null operations as necessary.

3. A more difficult effect to allow for is the checking for a clear RF channel and switching the RF TX/RX from receive mode to transmit mode. A possible method is to allow for a standard time and put that time in as an additional contribution. Then, if the channel is clear, the message goes out properly prepared. If the channel is not clear then during the waiting time before trying again, the message is reconstructed using the current value from the clock counter which is kept running.

Alternatively, the charnel may be checked before assembling the message and the message is then sent immediately it is assembled, taking the risk of the channel becoming occupied while the computation proceeds, but avoiding the need to estimate the RF channel clear check time. The choice of method will depend of system and microprocessor properties.

4. A wireless detonator assembly receiving the message, with a known age will deduct the known age from the system specified standard delay and use that difference as the time between the receipt of the message, as recorded on its own clock and the time on its own clock to initiate the firing countdown. It may as part of this operation continue to use the pulse count clock value, without the adjustments it made for retransmission purposes, as the relevant clock.

A further variant on this method can have the master controller (e.g. a blasting machine) send out a delay time as part of the message and the running clock pulse counter and other adjustments will deduct from that count so that finally the reduction to zero of the count will be the condition for initiation of action. Choice of the appropriate variant may depend on hardware implementation details.

The overall accuracy of the system may depend at least in part on accurate knowledge of calculation times and switching times so the details of the numeric values may depend upon the hardware and programme used. This does not affect the principles of operation of which the method described here represents a possible but not exclusive embodiment.

Example 5

Other Preferred Safety Features

In particularly preferred embodiments of the present invention, each wireless detonator assembly includes means of restricting the voltage of the electrical signal available to the detonator to safe, low values while people may be nearby, but which allows higher voltages to be employed when the firing stage is reached and the system is under remote control by the blast operator. An example of such wireless systems include, but are not limited to, the invention disclosed in PCT/AU2005/001684, which is incorporated herein by reference. This application discloses intrinsically safe detonators that may be 'powered-up' or 'charged' by a remote source of energy that is entirely distinct from the energy used for general command signal communications. The detonators may further include an active power source for supplying sufficient power for wireless communications, but insufficient power to cause actuation of the detonator.

With existing detonator systems, such as the i-kon system, a further safety feature is that a logging device, if used, cannot generate the necessary messages to take the EDD though the filing sequence. In the wireless system of the present invention, the top-box is unable to generate the necessary messages. A preferred feature of the present invention is that the actuation of the base charge in the below ground portion of a wireless detonator assembly requires transmission of the necessary FIRE signal(s) from a top-box (see FIG. 1). However, the top-box may not be amenable to receive and process a FIRE signal unless it is received from a blasting machine only after the blasting site is cleared and people are safe.

To provide personal safety, the people who work on the blast site normally have "keys" for the blasting machine that are necessary for it to function and so they must return to the blasting machine and insert them appropriately before blasting can begin. Such "keys" may take the form of a more traditional key, or alternatively may take the form of an electronic device or card comprising electronic memory storage. This latter feature enables another benefit. While logging wireless electronic detonators in the field it can be useful, if not essential, to check that the radio link to and from the blasting machine is functional while the logging people are nearby. (They may well move out of the radio field so as not to act as field distorting objects themselves). This can be done safely since the rest of the code for the blasting sequence may not be present in the blasting machine but rather held on a key comprising a memory chip in the possession of the blast operator. Furthermore, the blasting apparatus may be established such that only particular "keys" are operable with specific top-boxes. Thus the functioning of the wireless detonator assemblies can be restricted to intended users.

Example 6

Incorporation of Crystal Clocks into Wireless Detonator Assemblies of the Present Invention Crystal oscillators for timing clocks are not always acceptable for use in blasting applications as they are relatively fragile and susceptible to vibration of blasting operations. The alternative accepted procedure is to calibrate internal, free running, ring oscillator or similar clocks against an outside source. For example this can be done by sending a pair of timing signals about a second apart which each detonator uses to start and stop a counter driven by its internal clock. The count is then used to calibrate the clock. This can also be done in the wireless systems of the present invention. However, in preferred embodiments of the present invention the wireless detonator assemblies described include top-boxes as described herein. Since the top-boxes are positioned at or near the ground surface, for example for the receipt of wireless signals, an aspect of the present invention encompasses the incorporation of a crystal clock into the top box. The benefits of crystal clock accuracy are therefore conferred to the wireless detonator assemblies of the invention, with a lessened risk that the crystal clock will be subject to damage during blasting or establishment of the blasting arrangement. Moreover, the wireless detonator assemblies are 'aware' of time and so each can generate its own time signal for calibrating its own detonator. As a result, no synchronous timing signals from the blasting machines are necessarily needed.

Example 7

Trials Conducted in Troisdorf, Germany

A sample blasting apparatus of the invention was established for trial purposes. The apparatus comprises a single blasting machine, together with five test wireless detonator assemblies. Each wireless detonator assembly comprised a top-box that included wireless signal receiving and processing means, and two associated Ikon™ detonators. Therefore, ten detonators in total-were controlled by the blasting machine. The time for actuation of the explosive charges was determined on the basis of monitoring oscilloscope traces corresponding to signals received by the wireless detonator assemblies.

Figure 5A:
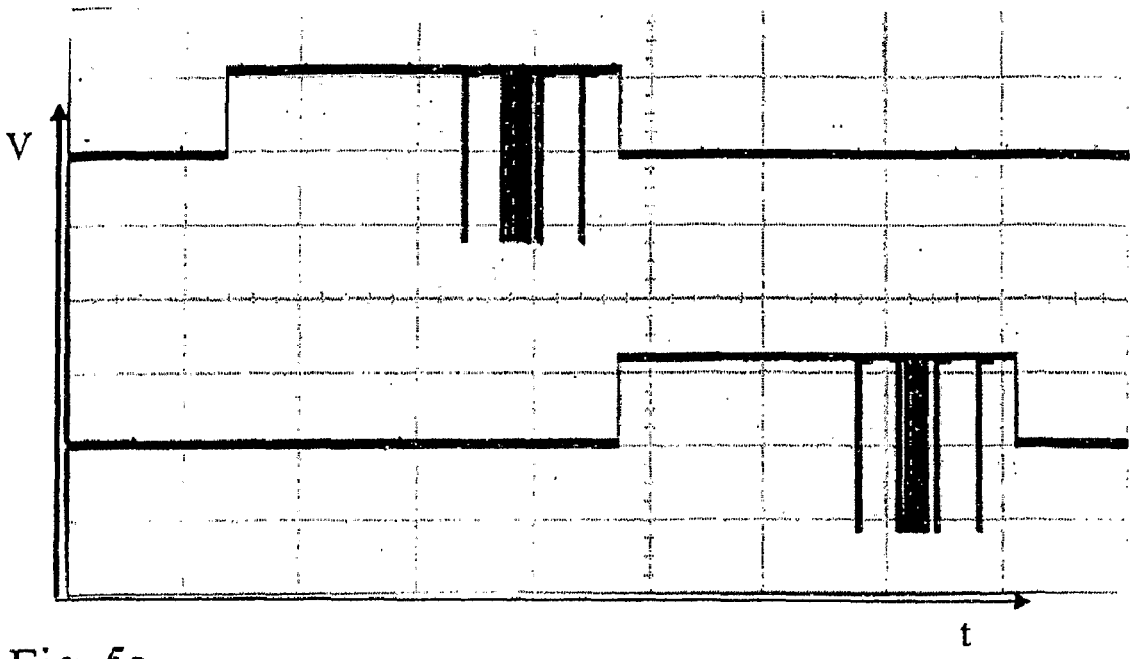
FIG. 5*a* provides sample oscilloscope traces for trials of a sample, preferred blasting apparatus of the present invention.

FIG. 5*a* illustrates oscilloscope traces for the logging of two individual detonators with a voltage level of 5V connected to a top-box. Prior to the test, each detonator replied to the logging signal with its respective ID number, and the ID numbers were stored in a memory within each top-box.

Figure 5B:
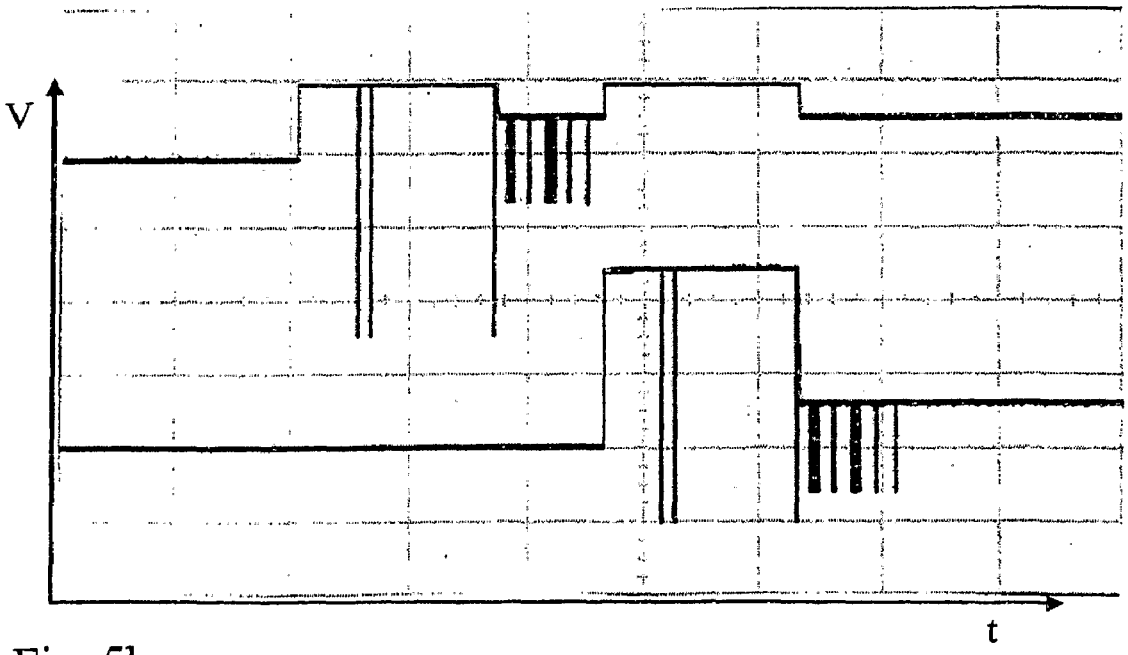
FIG. 5*b* provides sample oscilloscope traces for trials of a sample, preferred blasting apparatus of the present invention.

FIG. 5*b* illustrates oscilloscope traces for a calibration and programming sequence, and includes a step from 5V to 24V, and back to 5V. Each detonator was then programmed with the required delay times for the blast, and made ready to be fired. Prior to firing, the status of each detonator was checked by the blasting machine to ensure recognition of any failures that occurred during the calibration and programming sequence.

Figure 5C:
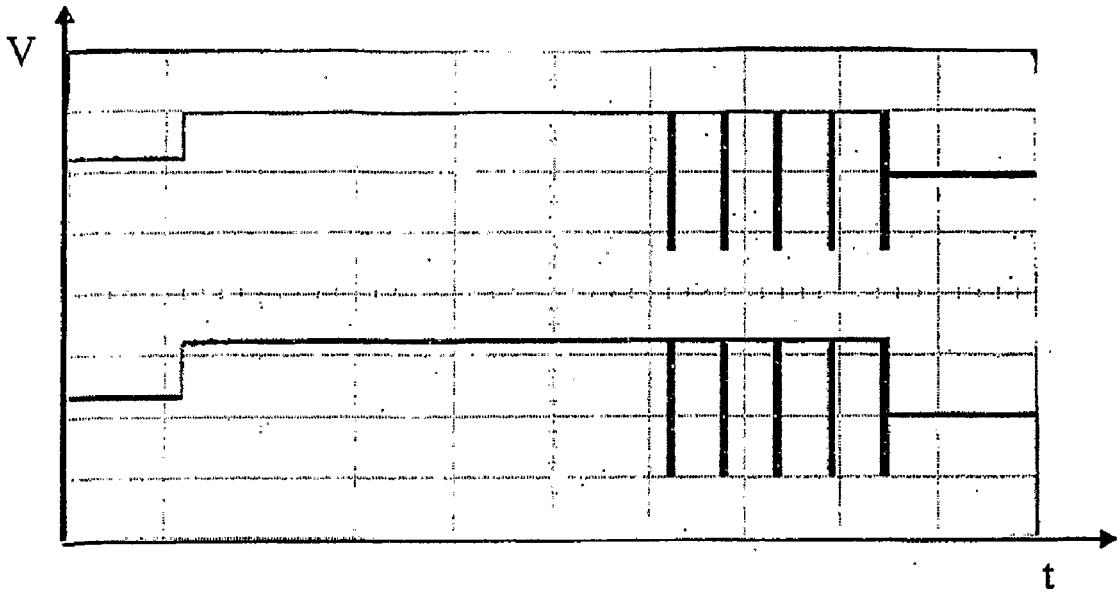
FIG. 5*c* provides sample oscilloscope traces for trials of a sample, preferred blasting apparatus of the present invention.
Figure 5D:
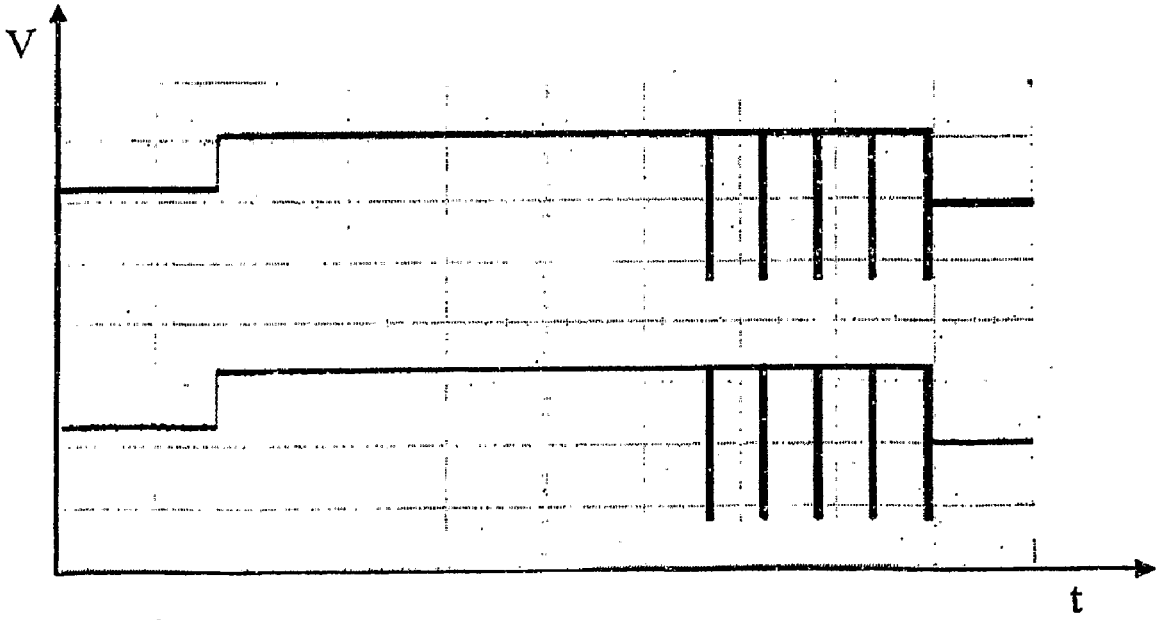
FIG. 5*d* provides sample oscilloscope traces for trials of a sample, preferred blasting apparatus of the present invention.

FIG. 5*c* illustrates control oscilloscope traces for the firing sequence of two detonators connected to the same top box. The traces are indistinguishable, and as expected they occurred at the same time. In contrast, FIG. 5*d* illustrates test oscilloscope traces for the fire sequence of two detonators connected to different top-boxes but given the same delay times. Importantly, these different top-boxes included alternative relay routes for the wireless signal. Nonetheless, the compensation for signal transmission delays at nodes in the network of wireless detonator assemblies, in accordance with the methods of the present invention, was successful resulting in indistinguishable oscilloscope traces showing simultaneous detonator actuation.

Whilst the invention has been described with reference to specific embodiments of the wireless detonator assemblies, blasting apparatuses, and methods of blasting of the present invention, a person of skill in the art would recognize that other wireless detonator assemblies, blasting apparatuses, and methods of blasting that have not been specifically described would nonetheless lie within the spirit of the invention. It is intended to encompass all such embodiments within the scope of the appended claims.

The invention claimed is:

1. A blasting apparatus for fragmentation of rock by timed actuation of a plurality of explosive charges each set in a borehole in the rock, the blasting apparatus comprising:

at least one blasting machine for transmitting at least one wireless command signal; and a plurality of wireless detonator assemblies, at least some of which are within range to receive said at least one wireless signal from said at least one blasting machine, each wireless detonator assembly associated with a corresponding explosive charge for causing actuation thereof upon transmission of a FIRE signal by an associated blasting machine, each wireless detonator assembly comprising:

(a) a base charge;

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c);

whereby the wireless detonator assemblies form a cross-communicating network of wireless detonator assemblies, each either in direct communication with said at least one blasting machine, or in indirect communication with said at least one blasting machine via relay of wireless signals to or from said at least one blasting machine via one or more nodes in the network, each node comprising a wireless detonator assembly.

2. The blasting apparatus of claim 1, wherein each wireless detonator assembly further comprises:

(e) an operating power supply for providing sufficient power to operate at least components (b), (c), and (d), but having insufficient power to cause initiation of said base charge in the absence of a command signal to FIRE from said at least one blasting machine; and (f) a firing power supply of sufficient power to cause initiation of said base charge, said firing power supply operable only upon receipt of a command signal to FIRE either directly from said at least one blasting machine, or indirectly from said at least one blasting machine via relay by one or more other wireless detonator assemblies.

3. The blasting apparatus of claim 1, wherein the relay of wireless signals occurs with respect to wireless command signals derived from said at least one blasting machine to said at least one wireless detonator assembly.

4. The blasting apparatus of claim 1, wherein the relay of wireless signals occurs with respect to wireless signals derived from said at least one wireless detonator assembly directed to said at least one blasting machine.

5. The blasting apparatus of claim 1, wherein at least one of said wireless detonator assemblies are within range for receiving said at least one wireless command signal from said at least one blasting machine, and relaying said at least one wireless command signal to further wireless detonator assemblies in the blasting apparatus that are out of range of said at least one wireless command signal transmitted by said at least one blasting machine.

6. The blasting apparatus of claim 5, wherein said further wireless detonator assemblies relay said at least one command signal to yet further wireless detonator assemblies in the blasting apparatus that are out of range of said at least one wireless command signal transmitted by said at least one blasting machine.

7. The blasting apparatus of claim 1, wherein all of said wireless detonator assemblies are within range for receipt of said at least one wireless command signal transmitted by said at least one blasting machine, and wherein said at least one blasting machine is out of range to receive signals transmitted by at least a portion of said wireless detonator assemblies, said wireless signals from wireless detonator assemblies that are too far from said at least one blasting machine to transmit wirelessly directly thereto, being relayed to said at least one blasting machine via wireless detonator assemblies within wireless communication range of said at least one blasting machine.

8. The blasting apparatus of claim 1, wherein each wireless detonator assembly includes means to record a wireless signal received thereby, and to ignore wireless signals that correspond substantially to wireless command signals previously received by each wireless detonator assembly.

9. The blasting apparatus of claim 1, wherein said at least one wireless signal comprises wireless command signals from said at least one blasting machine for receipt by said wireless detonator assemblies.

10. The blasting apparatus of claim 1, wherein said at least one wireless signal comprises information regarding the status of said at least one wireless detonator assemblies, for receipt by said at least one blasting machine.

11. The blasting apparatus of claim 1, wherein said at least one wireless signal comprises detonator identification and/or firing codes, for transmission from said wireless detonator assemblies to said at least one blasting machine.

12. The blasting apparatus of claim 1, wherein at least components b), c), and d) are located in a top-box separate from a below-ground portion of said wireless detonator assembly at least comprising a detonator shell and said base charge.

13. The blasting apparatus of claim 12, wherein said top-box is adapted for location at or near a ground surface level of a borehole suitable for receipt of wireless signals, said below-ground portion being suitable for positioning below ground in said borehole in association with an explosive charge.

14. The blasting apparatus of claim 13, wherein said top-box is in electrical communication with said below-ground portion of said detonator assembly.

15. The blasting apparatus of claim 12, wherein said at least one wireless signal comprises information with regard to the integrity of the electrical communication between each top-box and each associated below-ground portion of each wireless detonator assembly.

16. The blasting apparatus of claim 1, wherein each wireless detonator assembly further comprises:

(g) a clock suitable for timing initiation of said base charge in accordance with a programmed delay time upon receipt of a FIRE signal from said at least one blasting machine.

17. The blasting apparatus of claim 16 wherein the clock is a crystal clock.

18. The blasting apparatus of claim 16, wherein the clocks of the wireless detonator assemblies are synchronized, and wherein each wireless detonator assembly is programmed with firing time, said firing times optionally being different from one another such that upon receipt of a signal to FIRE by said wireless detonator assemblies, said wireless detonator assemblies firing in a desired sequence and/or at desired times according to said firing times.

19. The blast apparatus of claim 16, wherein the clocks of the wireless detonator assemblies are programmed to begin counting from a common time zero, each wireless detonator assembly programmable with a delay time from time zero to cause initiation of an associated base charge, said base charges firing in a predetermined sequence and/or at desired times according to said programmed delay times.

20. The blasting apparatus of claim 16, wherein said at least one wireless signal includes a clock calibration signal derived from a blasting machine.

21. The blasting apparatus of claim 16, wherein said at least one blasting machine and/or at least one wireless detonator assembly establishes a time zero, each wireless detonator assembly being programmable with a delay time from time zero to initiate an associated base charge upon receipt thereby of a FIRE signal from said at least one blasting machine, each base charge being initiated in response to said FIRE signal once an amount of time from time zero calculated according to equation X has elapsed:

amount of time from time zero to initiate each base charge=(time zero+programmed delay time specific for a wireless detonator assembly)−total time to process and relay said FIRE signal at each intermediary node in the network between said at least one blasting machine and each wireless detonator assembly; X whereby upon receipt of a FIRE signal each clock of each wireless detonator assembly counts down said amount of time from time zero to initiate an associated base charge, thereby to cause timed initiation of the bases charges associated with the wireless detonator assemblies in the network.

22. The blasting apparatus of claim 21, wherein said total lime to process and relay said FIRE signal at each intermediary node in the network between said at least one blasting machine and each wireless detonator assembly is calculated by:

starting a clock in each intermediary node of the network upon receipt of a wireless signal to be relayed;

stopping the clock in each intermediary node of the network upon transmission of said wireless signal to be relayed, thereby to provide a processing and transmission time for each intermediary node for incorporation into the wireless signal to be relayed; and upon receipt of said wireless signal by a node to which the wireless signal is directed, summating each processing and transmission time for each intermediary node through which the wireless signal has been relayed, thereby to provide said total time to process and relay said FIRE signal at each intermediary node in the network between said at least one blasting machine and each wireless detonator assembly.

23. The blasting apparatus of claim 22, wherein each wireless detonator assembly is pre-preprogrammed with a delay time before transmission of wireless command signals by said at least one blasting machine.

24. The blasting apparatus of claim 21, wherein each wireless detonator assembly is programmed with a delay time via receipt of a wireless signal comprising a delay time component, said total time to process and relay said FIRE signal at each intermediary node in the network between said at least one blasting machine and each wireless detonator assembly being calculated by:

starting a clock in each intermediary node of the network upon receipt of a wireless signal to be relayed;

stopping the clock in each intermediary node of the network just prior to transmission of said wireless signal to be relayed, thereby to provide a processing and transmission time for said intermediary node;

amending a delay time component of the wireless signal comprising the delay time component just prior to transmission of said wireless signal to be relayed, by deducting said processing and transmission time from said delay time;

whereby upon receipt of said wireless signal by a wireless detonator assembly to which the wireless signal is directed, said delay time component will already have been adjusted to compensate for each processing and transmission time for each intermediary node.

25. The blasting apparatus of claim 24, wherein each wireless signal comprising a delay time component comprises a signal to FIRE each wireless detonator assembly.

26. The blasting apparatus of claim 1, wherein each wireless signal derived from a blasting machine is assigned to a specific wireless detonator assembly by an accompanying detonator identification code.

27. The blasting apparatus of claim 16, wherein said at least one wireless signal comprises a timing calibration signal, to synchronize each clock of each wireless detonator assembly.

28. The blasting apparatus of claim 1, wherein each of said at least one wireless signal comprises a delay time for each detonator, each delay time including compensation for any relaying times to transfer each wireless signal through the network of wireless detonator assemblies.

29. The blasting apparatus according to claim 1, wherein each wireless detonator assembly is adapted for short-range communication with a logging device, to transmit information to the logging device selected from: detonator identification information, detonator firing codes, detonator status, and delay times, and/or to receive information from the logging device such as for example, detonator identification information, detonator firing codes, and delay times.

30. The blasting apparatus of claim 1, wherein the wireless signals comprise energy selected from the group consisting of: radio waves, light energy, microwaves, infrared and acoustic energy.

31. The blasting apparatus of claim 1, wherein each operating power supply is selected from the group consisting of: a capacitor, diode, a rechargeable battery an activatable battery, a fuel cell, an air cell, such as a hearing aid battery, and a micro-nuclear power source.

32. The blasting apparatus of claim 1, wherein each wireless detonator assembly further comprises a firing switch located between said firing power supply and said detonator, said firing switch switching from an OFF position to an ON position upon receipt of a wireless command signal to FIRE by said wireless signal receiving means, thereby establishing electrical connection between said firing power supply and said detonator, thereby to initiate said detonator.

33. The blasting apparatus of claim 1, wherein the wireless command signals are selected from the group consisting of: ARM signals, DISARM signals, FIRE signals, detonator delay times, and detonator firing codes.

34. The blasting apparatus of claim 1, wherein the at least one wireless command signal comprises a 'role call' signal to check for wireless communication with each wireless detonator assembly in the network.

35. The blasting apparatus of claim 1, wherein the at least one wireless command signal comprises logging signals to assign an identity to each wireless detonator assembly in the network.

36. The blasting apparatus of claim 1, wherein each wireless detonator assembly is able to receive and store identification information for each wireless detonator assembly in the network from which a wireless signal can be successfully received, such that each wireless detonator assembly can learn which other wireless detonator assemblies are upstream in wireless signal relay in the network.

37. The blasting apparatus of claim 1, wherein each wireless detonator assembly is able to receive and store identification information for each wireless detonator assembly in the network to which it can successfully transmit a wireless signal, such that each wireless detonator assembly can learn a sector of responsibility comprising wireless detonator assemblies downstream in wireless signal relay in the network.

38. The blasting apparatus of claim 36, wherein each wireless detonator assembly comprises a non-volatile memory for storing said identification information, such that each wireless detonator assembly can retain said identification information during a power down of the blasting apparatus.

39. A wireless detonator assembly suitable for use in connection with the blasting apparatus of claim 1, the wireless detonator assembly comprising:

(a) a base charge;

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c).

40. The wireless detonator assembly of claim 39, further comprising:

(e) an operating power supply for providing sufficient power to operate at least components (b), (c), and (d), but having insufficient power to cause initiation of said base charge in the absence of a command signal to FIRE from said at least one blasting machine; and (f) a firing power supply of sufficient power to cause initiation of said base charge, said firing power supply operable only upon receipt of a command signal to FIRE either directly from said at least one blasting machine, or indirectly from said at least one blasting machine via relay by one or more other wireless detonator assemblies.

41. The wireless detonator assembly of claim 39, further comprising:

storage means for storing detonator identification and/or firing codes received from a logger or an associated blasting machine.

42. The wireless detonator assembly of claim 39, wherein at least components b), c), and d) are located in a top-box separate from a below-ground portion of said wireless detonator assembly at least comprising a detonator shell and said base charge.

43. The wireless detonator assembly of claim 42, wherein said top-box is adapted for location at or near a ground surface level of a borehole suitable for receipt of wireless signals, said below-ground portion being suitable for positioning below ground in said borehole in association with an explosive charge.

44. The wireless detonator assembly of claim 42, wherein said top-box is in electrical communication with said below-ground portion of said wireless detonator assembly.

45. The wireless detonator assembly of claim 39, wherein each wireless detonator assembly further comprises:

(g) a clock suitable for timing initiation of said base charge in accordance with a programmed delay time upon receipt of a FIRE signal from said at least one blasting machine.

46. The wireless detonator assembly of claim 45 wherein the clock is a crystal clock.

47. The wireless detonator assembly of claim 39, wherein said wireless detonator assembly is adapted for short-range communication with a logging device, to transmit information to the logging device selected from: detonator identification information, detonator firing codes, detonator status, and delay times, and/or to receive information from the logging device such as for example, detonator identification information, detonator firing codes, and delay times.

48. The wireless detonator assembly of claim 39, wherein the wireless signal receiving means is able to receive wireless signals comprising energy selected from the group consisting of: radio waves, light energy, microwaves, infrared and acoustic energy.

49. The wireless detonator assembly of claim 39, wherein the wireless signal transmitting means is able to transmit wireless signals comprising energy selected from the group consisting of: radio waves, light energy, microwaves, infrared and acoustic energy.

50. The wireless detonator assembly of claim 39, wherein the wireless signal receiving means is able to receive energy selected from the group consisting of: radio waves, light energy, microwaves, infrared and acoustic energy.

51. The wireless detonator assembly of claim 40, wherein each operating power supply is selected from the group consisting of: a capacitor, diode, a rechargeable battery an activatable battery, a fuel cell, an air cell, such as a hearing aid battery, and a micro-nuclear power source.

52. The wireless detonator assembly of claim 40, wherein each wireless detonator assembly further comprises a firing switch located between said firing power supply and said detonator, said firing switch switching from an OFF position to an ON position upon receipt of a wireless command signal to FIRE by said wireless signal receiving means, thereby establishing electrical connection between said firing power supply and said detonator, thereby to initiate said detonator.

53. The wireless detonator assembly of claim 39, wherein the wireless signals are selected from the group consisting of: ARM signals, DISARM signals, FIRE signals, detonator delay times, and detonator firing codes.

54. The wireless detonator assembly of claim 39, wherein each wireless detonator assembly is able to receive and store identification information for each wireless detonator assembly in a network of wireless detonator assemblies from which a wireless signal can be successfully received, such that said wireless detonator assembly can learn which other wireless detonator assemblies are upstream in wireless signal relay in the network.

55. The wireless detonator assembly of claim 39, wherein said wireless detonator assembly is able to receive and store identification information for each wireless detonator assembly in a network of wireless detonator assemblies to which it can successfully transmit a wireless signal, such that said wireless detonator assembly can learn a sector of responsibility comprising wireless detonator assemblies downstream in wireless signal relay in the network.

56. The wireless detonator assembly of claim 54, wherein each wireless detonator assembly comprises a non-volatile memory for storing said identification information, such that each wireless detonator assembly can retain said identification information during a power down of the blasting apparatus.

57. A top-box, for use in connection with a detonator comprising a base charge and adapted for association with an explosive charge in borehole, the top-box adapted for location above the ground or at least in said borehole adjacent a surface of the ground, the top-box comprising:

(b) wireless signal receiving means, for receiving at least one wireless signal, each wireless signal transmitted from either a blasting machine or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine; and (d) wireless signal transmitting means for transmitting said at least one wireless signal as required by (c).

58. The top-box of claim 57, further comprising:

(a) a clock suitable for timing initiation of said base charge in accordance with a programmed delay time.

59. The top-box of claim 58, wherein the clock is a crystal clock.

60. The top-box of claim 57, further comprising:

(e) an operating power supply for providing sufficient power to operate at least components (b), (c), and (d), but having insufficient power to cause initiation of said base charge in the absence of a command signal to FIRE from said at least one blasting machine; and (f) a firing power supply of sufficient power to cause initiation of said base charge, said firing power supply operable only upon receipt of a command signal to FIRE either directly from said at least one blasting machine, or indirectly from said at least one blasting machine via relay by one or more other wireless detonator assemblies.

61. The top-box of claim 57, wherein said top-box is in wireless radio communication with said detonator.

62. The top-box of claim 57, wherein said top-box is in electrical communication with said detonator.

63. A method of blasting at a blast site, the method comprising the steps of:

providing a blasting apparatus according to claim 1;

placing a plurality of explosive charges at the blast site;

associating each wireless detonator assembly with each explosive charge such that actuation of each base charge will cause actuation of each associated explosive charge;

transmitting a wireless command signal to FIRE from said at least one blasting machine to each wireless detonator assembly, either directly, or indirectly via relay of each wireless command signal between wireless detonator assemblies.

64. The method of claim 63, wherein the command signals further comprise delay times for each detonator, thereby to cause the wireless detonator assemblies to fire in a specific timing pattern.

65. The method of claim 64, wherein each detonator comprises a stored firing code, and the command signals further comprise firing codes, each detonator firing only if a stored firing code and a firing code from a command signal correspond.

66. A method for timed actuation of a plurality of wireless detonator assemblies each comprising a base charge to be initiated in accordance with a delay time upon receipt of a signal to FIRE from at least one associated blasting machine, the method comprising the steps of:

providing a network of wireless detonator assemblies, each capable of receiving a wireless signal from a blasting machine or another wireless detonator assembly, and performing an action as required by the wireless signal and/or relaying the wireless signal to other wireless detonator assemblies in the network;

establishing a time zero;

programming each wireless detonator assembly in the network with a delay time from time zero for initiation of each base charge associated with each wireless detonator assembly;

calculating for each wireless detonator assembly an amount of time from a receipt of a FIRE signal to cause actuation of each associated base charge, according to equation X:

amount of time from receipt of a FIRE signal to initiate the base charge=(time zero+programmed delay time specific for each wireless detonator assembly)−total time to process and relay said FIRE signal at each intermediary node in the network between said at least one blasting machine and each wireless detonator assembly; (X)

whereby each clock in each wireless detonator assembly counts down said amount of time from receipt of said FIRE signal to initiate the base charge, thereby to cause timed initiation of each wireless detonator assembly.

67. The method of claim 66, wherein said total time to process and relay said FIRE signal at each intermediary node in the network between said at least one blasting machine and each wireless detonator assembly is calculated by:

starting a clock in each intermediary node of the network upon receipt of a wireless signal to be relayed;

stopping the clock in each intermediary node of the network upon transmission of said wireless signal to be relayed, thereby to provide a processing and transmission time for each intermediary node for incorporation into the wireless signal to be relayed; and upon receipt of said wireless signal by a node to which the wireless signal is directed, summating each processing and transmission time for each intermediary node through which the wireless signal has been relayed, thereby to provide said total time to process and relay said FIRE signal at each intermediary node in the network between said at least one blasting machine and each wireless detonator assembly.

68. The method of claim 67, wherein each wireless detonator assembly is pre-programmed with a delay time before transmission of wireless command signals by said at least one blasting machine.

69. The method of claim 67, wherein each wireless detonator assembly is programmed with a delay time via receipt of a wireless command signal comprising a delay time component, said total time to process and relay said FIRE signal at each intermediary node in the network between said at least one blasting machine and each wireless detonator assembly being calculated by:

starting a clock in each intermediary node of the network upon receipt of a wireless signal to be relayed;

stopping the clock in each intermediary node of the network just prior to transmission of said wireless signal to be relayed, thereby to provide a processing and transmission time for said intermediary node;

amending a delay time component of the wireless signal comprising the delay time component just prior to transmission of said wireless signal to be relayed, by deducting said processing and transmission time from said delay time;

whereby upon receipt of said wireless signal by a wireless detonator assembly to which the wireless signal is directed, said delay time component will be already have been adjusted to compensate for each processing and transmission time for each intermediary node.

70. The method of claim 69, wherein each wireless command signal comprises a delay time component comprising a signal to FIRE each wireless detonator assembly.

71. Use of the blasting apparatus of claim 1, in a mining operation.

72. Use of a wireless detonator assembly of claim 39, in a mining operation.

73. Use of a top-box of claim 57, in a mining operation.

74. Use according to claim 71, wherein the mining operation is an automated mining operation comprising robotic placement of explosive charges and detonators at the blast site.

75. A blasting apparatus for fragmentation of rock by timed actuation of a plurality of explosive charges each set in a borehole in the rock, the blasting apparatus comprising:

at least one blasting machine for transmitting at least one wireless command signal;

one or more wireless trunk lines each comprising one or more relay devices for wirelessly relaying said at least one wireless command signal;

a plurality of wireless detonator assemblies, each in wireless signal communication either directly with said at least one blasting machine, or indirectly with said at least one blasting machine via one or more relay devices in one of said wireless trunk lines, each wireless detonator assembly associated with a corresponding explosive charge for causing actuation thereof upon transmission of a FIRE signal by an associated blasting machine.

76. The blasting apparatus of claim 75, wherein each wireless detonator assembly comprises:

(a) a base charge;

(b) wireless signal receiving means, for receiving at least one wireless signal, each wireless signal transmitted from either a blasting machine (either directly or via a relay device) or another nearby wireless detonator assembly;

(c) wireless signal processing means for determining an action required by said wireless detonator assembly in response to each wireless signal received by (b), and whether to relay said wireless signal to another wireless detonator assembly and/or to a blasting machine and/or to a relay device;

(d) wireless signal transmitting means for transmitting said at least one wireless signal as required by (c);

(e) an operating power supply for providing sufficient power to operate at least components (b), (c), and (d), but having insufficient power to cause initiation of said base charge in the absence of a command signal to FIRE from said at least one blasting machine; and (f) a firing power supply of sufficient power to cause initiation of said base charge, said firing power supply operable only upon receipt of a command signal to FIRE either directly from said at least one blasting machine, or indirectly from said at least one blasting machine via relay by one or more other wireless detonator assemblies;

whereby the wireless detonator assemblies form a cross-communicating network of wireless detonator assemblies, each either in direct communication with said at least one blasting machine, or in indirect communication with said at least one blasting machine via relay of wireless signals to or from said at least one blasting machine via one or more nodes in the network, each node comprising either a wireless detonator assembly or a relay device in a wireless trunk line.

77. The blasting apparatus of claim 1, further comprising a central command station remote from the blast site, said central command station generating and transmitting wireless command signals to control said at least one blasting machine, and communication between said at least one blasting machine and said wireless detonator assemblies.

78. The blasting apparatus of claim 1, further comprising at least one emergency override means, for communicating an emergency override wireless signal to at least one other component of the blasting apparatus.

79. The blasting apparatus of claim 78, wherein each wireless detonator assembly comprises an emergency override means for communicating an emergency override signal to said at least one blasting machine.

80. The blasting apparatus of claim 79, wherein each blasting machine comprises an emergency override means for communicating an emergency override signal to each wireless detonator assembly.

81. The blasting apparatus of claim 79, wherein said emergency override signal causes shutdown of the blasting apparatus.

82. The blasting apparatus of claim 30, wherein the radio waves have a frequency of 100-2000 Hz.

83. The blasting apparatus of claim 82, wherein the radio waves have a frequency of 200-1200 Hz.

84. A method of blasting at a blast site, which comprises:

providing explosive charges at a plurality of locations and providing each charge with an operable detonator assembly;

establishing communication among said detonator assemblies, and communication between at least one of said detonators and a blasting machine;

communicating at least one signal between said blasting machine and said at least one detonator assembly, said at least one signal containing firing information for said detonators; and causing said detonator assemblies to disseminate said firing information among all said detonator assemblies, while compensating for signal transmission delays among said detonators, thereby enabling said detonators to detonate said explosive charges in accordance with said firing information.

85. The method of claim 84, wherein said at least one signal is a wireless signal.

86. The method of claim 84, wherein said dissemination of said firing information occurs via wireless communication between said detonator assemblies.

* * * * *